US007578343B2

(12) United States Patent
Augustine

(10) Patent No.: US 7,578,343 B2
(45) Date of Patent: Aug. 25, 2009

(54) VISCOUS OIL INFLOW CONTROL DEVICE FOR EQUALIZING SCREEN FLOW

(75) Inventor: Jody R. Augustine, League City, TX (US)

(73) Assignee: Baker Hughes Incorporated, Houston, TX (US)

( * ) Notice: Subject to any disclaimer, the term of this patent is extended or adjusted under 35 U.S.C. 154(b) by 99 days.

(21) Appl. No.: 11/844,212

(22) Filed: Aug. 23, 2007

(65) Prior Publication Data

US 2009/0050313 A1 Feb. 26, 2009

(51) Int. Cl.
*E21B 43/00* (2006.01)

(52) U.S. Cl. ..... 166/227; 166/205

(58) Field of Classification Search ..... 166/205, 166/227, 233, 157

See application file for complete search history.

(56) References Cited

U.S. PATENT DOCUMENTS

| | | | |
|---|---|---|---|
| 5,215,146 | A | 6/1993 | Sanchez |
| 5,293,935 | A | 3/1994 | Arterbury et al. |
| 5,881,809 | A | 3/1999 | Gillespie et al. |
| 5,896,828 | A | 4/1999 | Kronschnabel et al. |
| 6,119,776 | A | 9/2000 | Graham et al. |
| 6,158,510 | A | 12/2000 | Bacon et al. |
| 6,220,345 | B1 * | 4/2001 | Jones et al. ..... 166/51 |
| 6,257,334 | B1 | 7/2001 | Cyr et al. |
| 6,325,150 | B1 | 12/2001 | Rayssiguier |
| 6,371,210 | B1 | 4/2002 | Bode et al. |
| 6,478,091 | B1 | 11/2002 | Gano |
| 6,481,494 | B1 | 11/2002 | Dusterhoft et al. |
| 6,547,011 | B2 | 4/2003 | Kilgore |
| 6,568,472 | B1 | 5/2003 | Gano et al. |
| 6,708,763 | B2 | 3/2004 | Howard et al. |
| 6,978,840 | B2 | 12/2005 | Henderson |
| 6,994,170 | B2 | 2/2006 | Echols |
| 7,032,675 | B2 | 4/2006 | Steele et al. |
| 7,055,598 | B2 | 6/2006 | Ross et al. |
| 7,059,401 | B2 | 6/2006 | Bode et al. |

(Continued)

FOREIGN PATENT DOCUMENTS

| | | |
|---|---|---|
| CN | 1073235 | 6/1993 |

(Continued)

OTHER PUBLICATIONS

Bowen, Eddie G., et al., "Providing Floating Capabilities in Latest-Generation Sand Screens", SPE/PS/CHOA 117615, Oct. 2008, 1-6.

(Continued)

*Primary Examiner*—David J Bagnell
*Assistant Examiner*—Catherine Loikith
(74) *Attorney, Agent, or Firm*—Steve Rosenblatt

(57) ABSTRACT

A flow balancing system for long screen sections particularly useful in high viscosity hydrocarbon production features an annular flow path whose height and length can be varied to provide a predetermined resistance to a given flow rate of a material of a given viscosity. In assembling a long length of screen sections, greater resistance configurations are placed closer to the wellhead end of the screen section with the more remote sections having progressively less restriction until the furthest section of the screen string where low or no resistance to flow internally to the screen section is offered.

13 Claims, 1 Drawing Sheet

U.S. PATENT DOCUMENTS

Figure 1:
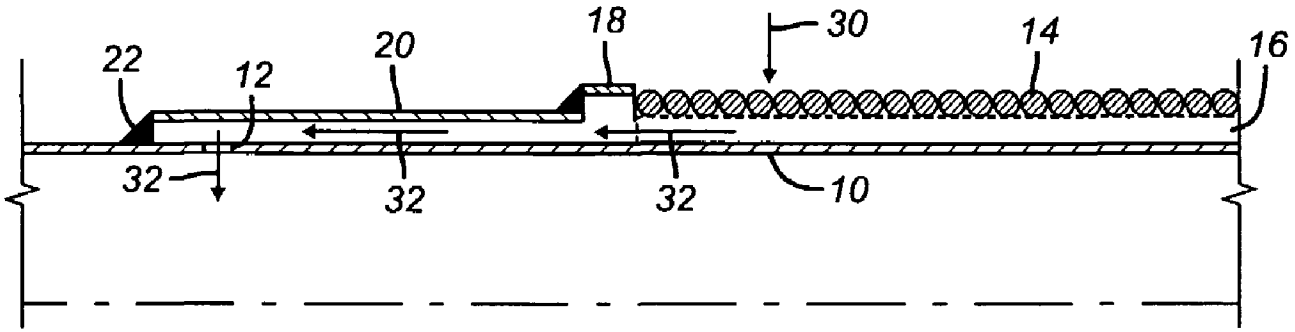

| | | | | |
|---|---|---|---|---|
| 7,090,014 | B2 | 8/2006 | Good et al. | |
| 7,096,945 | B2 | 8/2006 | Richards et al. | |
| 7,147,057 | B2 | 12/2006 | Steele et al. | |
| 2006/0237197 | A1 | 10/2006 | Dale et al. | |
| 2007/0246407 | A1 * | 10/2007 | Richards et al. | 210/97 |

FOREIGN PATENT DOCUMENTS

| | | | |
|---|---|---|---|
| RU | 2267605 | 1/2006 | |
| WO | 2006/130748 | A1 | 12/2006 |

OTHER PUBLICATIONS

Singhal, Ashok K., et al., "Screening and Design Criteria for Steam Assisted Gravity Drainage (SAGD) Projects", SPE 50410, Nov. 1998, 1-7.

Richards, M., et al., "Solids Control and Waste Management for SAGD", SPE/PS-CIM/CHOA 97670, Nov. 2005, 1-5.

* cited by examiner

VISCOUS OIL INFLOW CONTROL DEVICE FOR EQUALIZING SCREEN FLOW

FIELD OF THE INVENTION

The field of the invention is production techniques for equalizing flow from formations and more particularly from formations that produce more viscous hydrocarbons in the preferred range of about 20-1000 centipoise.

BACKGROUND OF THE INVENTION

Some completions involve long runs of screens in the producing zone. To get more balanced production along a lengthy section of screen that in some cases could be thousands of feet long devices have been used to offer different resistance at different locations along the screen sections. The screen sections closest to the surface that constitute a potential path of least resistance would need more restriction that screen sections further down. What has been tried in the past is illustrated in U.S. Pat. No. 6,622,794. In this patent screen sections had an annular space between a base pipe and the screen and inserted in the annular space before the flow could get to openings in the base pipe were helical paths that offered different degrees of resistance to a given flow rate. Using this design would require expensive machining raising the cost of each stand of screen. Additionally, an inventory of different screens opening sizes had to be kept and for each screen opening size the spiral paths that created different levels of resistance to a given flow also had to be kept in inventory for a variety of different completion situations. Beyond that, the screen sections needed to be carefully marked so that they would be assembled at the well in the correct order so as to provide more flow resistance closer to the wellhead and tapering down to less of no resistance at locations most remote from the wellhead.

Apart from this design sliding sleeves have been run with screens and some examples of those designs are U.S. Pat. Nos. 5,896,928; 6,371,210; 7,096,945; 7,055,598; 6,994,170; 6,481,494; 6,978,840; 6,568,472 and US Publication No. 2006/0237197.

The present invention provides an economical design for balancing screen flow particularly well suited for applications where highly viscous hydrocarbons about 10 to 10,000 centipoise with a preferred range of 20-1000 centipoise are being produced. In these situations the screen design incorporated an annular flow path to the base pipe openings that can be high enough to pass solids that might clear a screen and yet provide enough flow resistance at high viscosities to achieve the desired screen flow balancing. The design is considerably cheaper to produce than the prior spiral path designs. These and other benefits of the present invention will be more readily apparent to those skilled in the art from a review of the description of the preferred embodiment and the associated drawings while recognizing that the claims are the full measure of the invention.

SUMMARY OF THE INVENTION

A flow balancing system for long screen sections particularly useful in high viscosity hydrocarbon production features an annular flow path whose height and length can be varied to provide a predetermined resistance to a given flow rate of a material of a given viscosity. In assembling a long length of screen sections, greater resistance configurations are placed closer to the wellhead end of the screen section with the more remote sections having progressively less restriction until the furthest section of the screen string where low or no resistance to flow internally to the screen section is offered.

Figure 2:
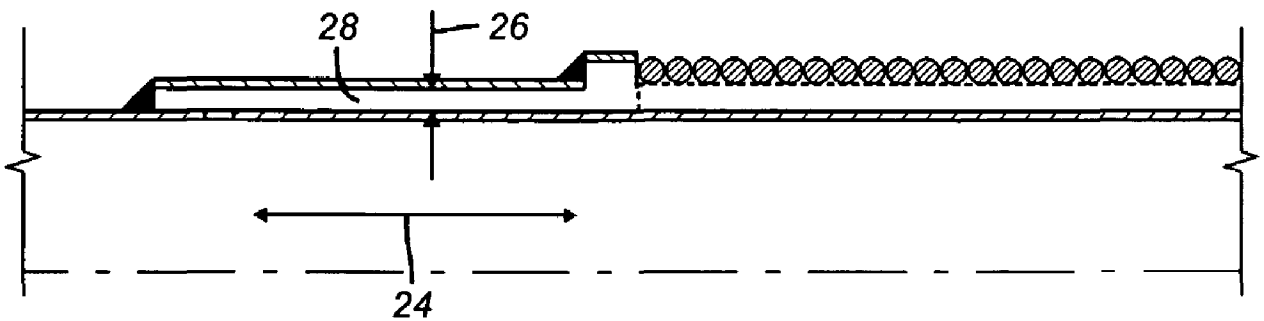

FIG. 1 is a section view of a screen section showing the flow pattern through it; and FIG. 2 is the view of FIG. 1 showing the variables of path height and length that can be varied to affect resistance to flow.

DETAILED DESCRIPTION OF THE PREFERRED EMBODIMENT

Referring now to FIG. 1 a base pipe 10 has at least one port 12. A screen 14, such as a wire wrap type for example, goes over the base pipe 10 to define an annular space 16. An end ring 18 is secured in a sealed manner to an end of screen 14 and a sleeve 20 is either integral or extends from end ring 18. Sleeve 20 terminates in a sealed manner against the base pipe 10 at end 22. Those skilled in the art will appreciate that only one end of one screen section is shown to illustrate the manner in which flow is balanced among screen sections in a producing formation. At the other end of the screen section shown in FIG. 1, the opposite end of screen 14 is secured in a sealed manner to the base pipe 10 to define the end of annular space 16. In the preferred embodiment the openings 12 are at the end shown in FIG. 1 but the screen section in FIG. 1 can have a mirror image at the opposite and end not shown as the end illustrated in FIG. 1. If that is done the length 24 of passage 28 as well as its height 26 as illustrated in FIG. 2 would have to be adjusted to reflect the alternative direction flow 30 could take as it enters the annular space 16. The height 26 can be uniform along the length 24 or it can be non-uniform. The length 24 is preferably unobstructed. If the openings 12 are only at one end, as illustrated in FIG. 1 then the flow 30 goes through the screen section 14 and enters the annular space 16 and moves toward openings 12 as illustrated by arrows 32.

It should be noted that the openings 12 are preferably not flow restrictive when compared to passage 28. Additionally, the assembly from end ring 18 to end 22 is simple to fabricate in a variety of lengths and heights. Screen sections need not be finished until ordered for a specific job and then quickly welded to the base pipe 10 after the openings 12 are properly located.

It is preferred that the illustrated sleeve over a tubular design be used for fluids having preferred viscosities of at least about 20 centipoise so that the height 26 can be greater than the size of particles that may get through the screen 14 during normal filtration activities.

Those skilled in the art will appreciate that the preferred embodiment illustrates a cost effective design that reduces inventory cost and can be fabricated to suit when a specific job is ordered or even at a local stocking warehouse just prior to shipment to a job. The use of an annular flow path also reduces risk of clogging from solids that get through the screen 14. It is far simpler than spiral designs that wrap around many times before coming to the base pipe openings. Optionally, some baffles can be used for structural support or for reduction of turbulence in passage 28. If the well is short enough, the same flow resistance in passages 28 for the various screen sections may be used along the entire length. Or, if the goal is to react to the formation permeability heterogeneity, the same flow resistance may be used in conjunction with annular isolation packers.

The above description is illustrative of the preferred embodiment and many modifications may be made by those skilled in the art without departing from the invention whose scope is to be determined from the literal and equivalent scope of the claims below.

I claim:

1. An inflow control system for high viscosity hydrocarbons into a screen assembly, comprising:

at least two screen sections each comprising a screen wrapped around a base pipe with at least one opening in the base pipe and an annular space between said screen and said base pipe in flow communication with said base pipe opening;

at least one flow control device in at least one of said sections in flow communication with said annular space, said device comprising exclusively an annularly shaped passage from said annular space to said opening, said base pipe opening being sized so that a substantial portion of the pressure drop due to the flow between said screens and said base pipe occurs at said flow control device.

2. The system of claim 1, wherein:

said device comprises a sleeve secured to said screen on one end and to said base pipe on an opposite end.

3. The system of claim 2, wherein:

said sleeve overlaps said opening in said base pipe.

4. The system of claim 3, wherein:

said passage creates substantially all the pressure drop from said annulus through said opening in said base pipe.

5. The system of claim 4, wherein:

said flow control device is present in every screen section and is configured to provide more resistance to a given flow rate among the screen sections in a direction going uphole.

6. The system of claim 5, wherein:

said flow control device is sized for hydrocarbons having a viscosity in excess of 20 centipoise.

7. The system of claim 5, wherein:

said flow control device is sized for hydrocarbons having a viscosity in the range of about 10-10,000 centipoise.

8. The system of claim 5, wherein:

said flow control device is sized for hydrocarbons having a viscosity in the range of about 20-1,000 centipoise.

9. The system of claim 4, wherein:

said flow control device is present in every screen section and is configured to provide about the same resistance to a given flow rate among the screen sections in a direction going uphole.

10. The system of claim 1, wherein:

said passage has a uniform height.

11. The system of claim 1, wherein:

said passage has a non-uniform height.

12. The system of claim 1, wherein:

said passage is unobstructed along its length.

13. The system of claim 1, wherein:

said base pipe has openings at opposed ends of said screen and said at least one flow control device comprises a flow control device on opposed ends of said screen.

* * * * *